US005273408A

United States Patent [19]

Yuge

[11] Patent Number: 5,273,408

[45] Date of Patent: Dec. 28, 1993

[54] VARIABLE-DISPLACEMENT VANE PUMP

[75] Inventor: Kazuyoshi Yuge, Fuji, Japan

[73] Assignee: Jatco Corporation, Japan

[21] Appl. No.: 49,338

[22] Filed: Apr. 21, 1993

[30] Foreign Application Priority Data

Apr. 28, 1992 [JP] Japan ..... 4-136297

[51] Int. Cl.[5] ..... F01C 21/16

[52] U.S. Cl. ..... 418/30; 418/26

[58] Field of Search ..... 418/30, 31, 75, 83, 418/24–27; 417/220

[56] References Cited

U.S. PATENT DOCUMENTS 4,558,998 12/1985 Kiyoshige et al. ..... 418/30

5,178,525 1/1993 Murota ..... 418/30

FOREIGN PATENT DOCUMENTS 62-276286 12/1987 Japan .

3-181673 8/1991 Japan ..... 418/30

OTHER PUBLICATIONS

"Maintenance and Repair Manual for Full Range E-AT, Model RE4R01A", Nissan Motor Co., Ltd. (Mar. 1987) pp. I-76 and II-54.

*Primary Examiner*—Richard A. Bertsch

*Assistant Examiner*—Charles G. Freay

*Attorney, Agent, or Firm*—Oliff & Berridge

[57] ABSTRACT

A lubricating groove not communicating with other oil passages and extending in the circumferential direction is provided on the side surface of a cam ring. The central portion in the circumferential direction of the lubricating groove is located at the center of the suction side, and both ends of the lubricating groove reach the positions beyond a straight line joinning the upper and lower dead points. As a result, the side surface of the cam ring of the variable-displacement vane pump is prevented from seizing.

3 Claims, 5 Drawing Sheets

VARIABLE-DISPLACEMENT VANE PUMP

BACKGROUND OF THE INVENTION

1. Field of the Invention

The present invention relates to a variable-displacement vane pump, specifically to a variable-displacement vane pump used as a hydraulic pressure supply source for an automatic transmission.

2. Description of the Related Art

A conventional variable-displacement vane pump is disclosed in Japanese Patent Application Laying-open No. 62-276286. In this variable-displacement vane pump, a groove is provided over a semicircumference on the side surface of a cam ring, and both ends of the groove communicate with a suction-side containment portion and a discharge-side containment portion, respectively. This reduces an eccentric load exerted on the cam ring, and prevents occurrence of cavitation.

However, the above conventional variable-displacement vane pump has a problem in that the groove provided on the side surface of the cam ring tends to be clogged. Specifically, since this groove communicates with a hydraulic pressure passage at the inner peripheral surface side of the cam ring, debris being adhered in assembling, burrs peeled during operation the, and abrasion powder due to the vane rotation come into the groove. Such dust in the groove stays at a place in the groove where the average pressure is the lowest, that is, at the suction port side, and comes in between the side surface of the cam ring and a housing. As a result, seizing occurs on the side surface of the cam ring.

SUMMARY OF THE INVENTION

It is a primary object of the present invention to provide a variable-displacement vane pump which solves such prior art problems and prevents a cam ring from seizing.

The present invention solves the above problems by providing a lubricating groove, which does not communicate with an oil passage, on the side surface of a cam ring. Specifically, the variable-displacement vane pump according to the present invention comprises housings as a casing of an oil pump, a cam ring having an adjustable eccentricity provided in a chamber formed by the housings, a rotor disposed in a bore of the cam ring, a plurality of vanes supported by the rotor movable in a radial direction and rotatable with the rotor in contact with the inner peripheral surface of the cam ring, a piston capable of adjusting the eccentricity of the cam ring; and wherein a lubricating groove is provided on a side surface of the cam ring, not communicating with inner and outer peripheries of the cam ring nor with other oil passages, the lubricating groove intersects a first straight line on the side surface of the cam ring joinning the upper and lower dead points at least at its one end, and the other end of the lubricating groove intersects a second straight line on the side surface of the cam ring perpendicularly crossing the first straight line and extending from the central point of the cam ring to a suction port side.

Here, the lubricating groove may intersect the first straight line on the side surface of the cam ring joinning the upper and lower dead points at its both ends, and the lubricating groove may intersect the second straight line on the side surface of the cam ring perpendicularly crossing the first straight line and extending from the central point of the cam ring to the suction port side.

The lubricating groove may be formed over the entire circumference on the side surface of the cam ring.

Oil leaking from the discharge port side through clearances between the cam ring side surface and the housings flows into the lubricating groove formed on the cam ring side surface. This oil also flows through the lubricating groove to the suction port side, thereby achieving sufficient lubrication. As described above, oil flows into the lubricating groove through the narrow clearances between the cam ring side surface and the housings, dust and the like are hard to flow in, and fine dust is discharged through the clearances between the cam ring side surface and the housings. Therefore, the cam ring is prevented from seizing due to dust in the lubricating groove. Furthermore, since oil supplied to the lubricating groove is oil leaked through the clearances, the discharge amount will not decrease due to the lubricating groove.

With the present invention, since the lubricating groove not communicating with other oil passages is provided on the side surface of the cam ring, and oil at the upper dead point side or the lower dead point side is conducted to the suction side, the suction side surface of the cam ring can be sufficiently lubricated, and the staying of dust or the like in the lubricating groove is prevented, thereby achieving a smooth rocking action of the cam ring.

The above and other objects, effects, features and advantages of the present invention will become more apparent from the following description of embodiments thereof taken in conjunction with the accompanying drawings.

DETAILED DESCRIPTION OF PREFERRED EMBODIMENT

Figure 1:
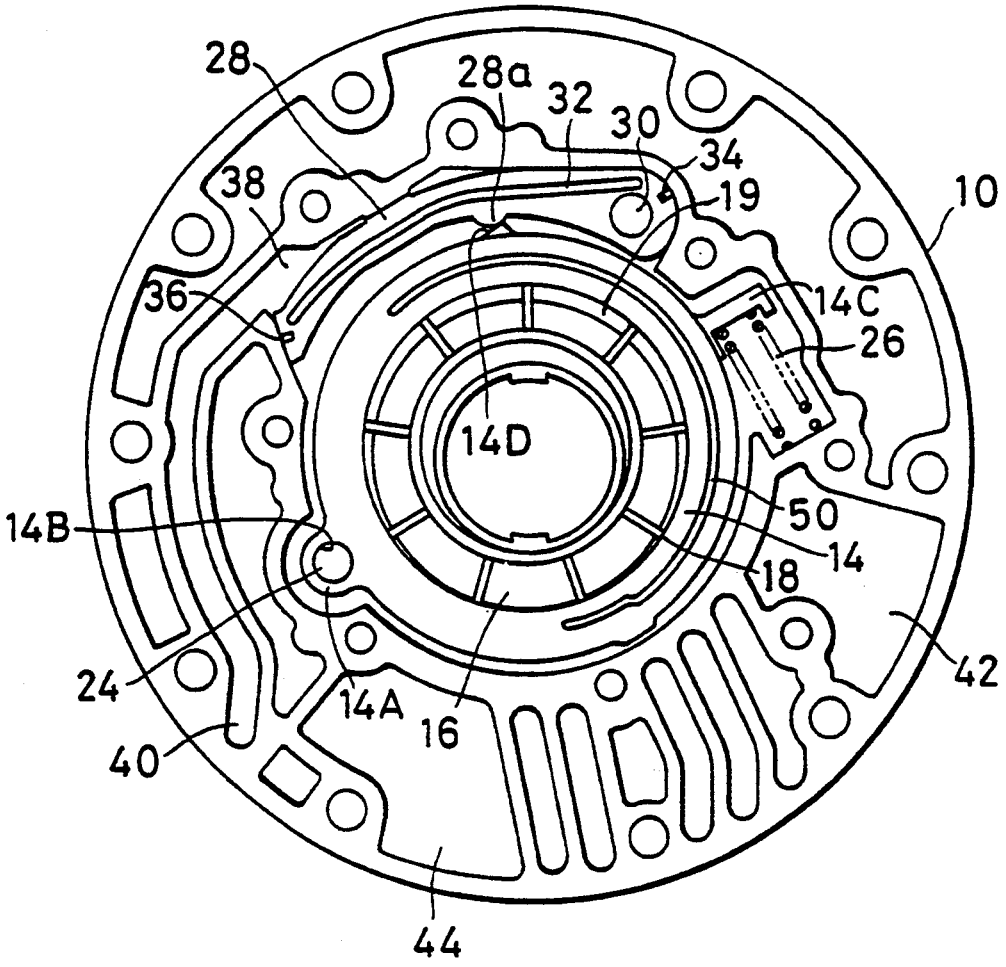
FIG. 1 is a schematic illustration (viewed along line 1—1 in FIG. 2) showing a variable-displacement vane pump of an embodiment according to the present invention.
Figure 2:
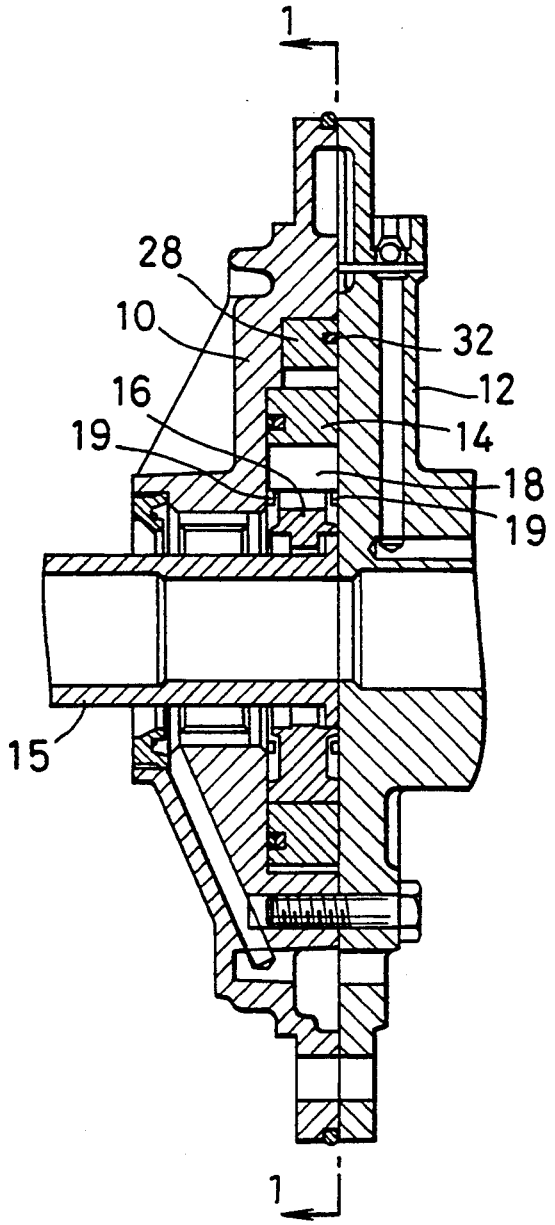
FIG. 2 is a schematic cross sectional illustration of the variable-displacement vane pump shown in FIG. 1.
Figure 3:
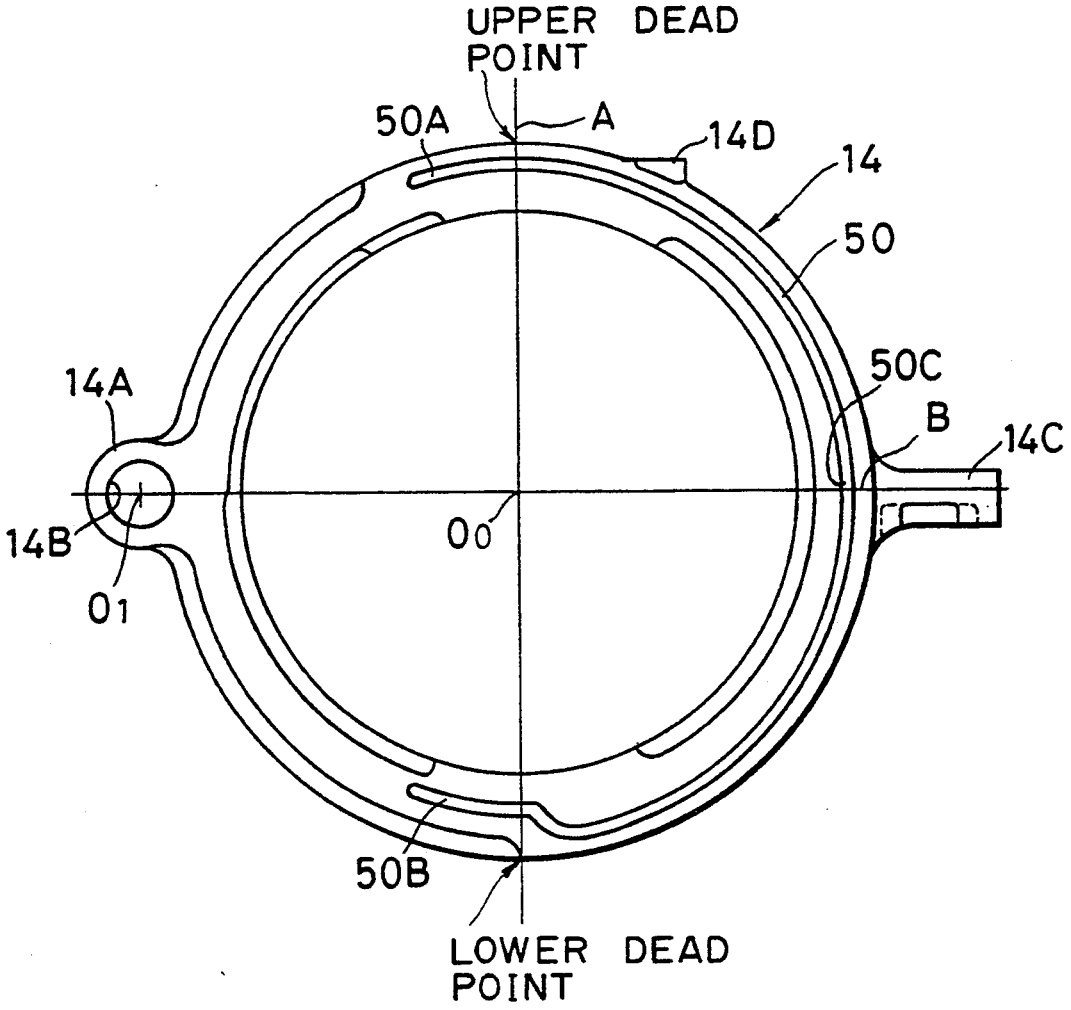
FIG. 3 is a schematic illustration showing a cam ring in an embodiment of the present invention.

A first embodiment of the present invention is shown in FIGS. 1, 2 and 3. A variable-displacement vane pump comprises a cam ring 14 having a bore, a rotar 16, a plurality of vanes 18, a vane ring 19, and the like provided in a chamber formed by a casing comprising a housing 10 and a cover housing 12. The rotor 16 is driven, for example, by a rotary shaft 15 integral with a torque converter (not shown). The cam ring 14 is provided with a projection 14A projecting from its outer periphery, and the projection 14A is formed with a hole 14B which is rotatably engaged with a pin 24 mounted to the housings 10 and 12. The cam ring 14 is provided rockable or swingable about the pin 24. The eccentricity of the cam ring 14 from the center of the rotor 16 is varied by rocking the cam ring 14. Furthermore, the cam ring 14 is provided with a spring retainer 14C at a position nearly opposing the projection 14A formed with the hole 14B, and is urged in a direction to increase the eccentricity with the rotor 16 by a return spring 26 disposed between the spring retainer 14C and the housing 10. On the side surface of the cam ring 14 facing the cover housing 12 is provided a lubricating groove 50 having a circumferential length exceeding the semicircumference as shown in FIG. 3. The lubricating groove 50 does not communicate with the inner peripheral side and the outer peripheral side of the cam ring 14, nor with other oil passages. One end 50A (upper end side in FIG. 1) of the lubricating groove 50 extends to the left side in FIG. 1 of a straight line A joining upper and lower dead points. The upper and lower dead points here are referred individually to those points where the straight line A perpendicularly crossing a straight line, which joins a rocking center $O_1$ of the cam ring 14 with the center $O_0$ of the cam ring 14, and passing the center $O_0$ intersects the outer peripheral surface of the cam ring 14. The other end 50B (lower end side in FIG. 1) of the lubricating groove 50 also extends to the left side in FIG. 1 of the straight line A. A central portion 50C nearly at the center in the circumferential direction of the lubricating groove 50 is located at the center of a suction port, that is, a position close to a straight line B perpendicularly crossing the straight line A and passing the center $O_0$ of the cam ring 14, in other words, in the vicinity of the spring retainer 14C. A nearly arc-formed lever-like piston 28 is provided along the outer periphery of the cam ring 14. The lever-like piston 28 is swingable about a pin 30 mounted to the housings 10 and 12. The lever-like piston 28 has a protrusion **28*a* having a nearly semicircular cross section at the inner peripheral side, and an inclined flat portion 14D is provided on the outer periphery of the cam ring 14 at a position corresponding to the protrusion 28*a*. A sealing member 32 is provided on the side surface of the lever-like piston 28, and sealing members 34 and 36 are also provided at contact parts of both ends of the lever-like piston 28 with the housing wall. This forms an oil chamber 38 at the backside of the lever-like piston 28. The oil chamber 38 can be supplied with a hydraulic pressure from an oil passage 40. The housing 10 is provided with a suction port 42 and a discharge port 44**.

Then, the operation of the present embodiment will be described. When the rotor 16 is rotated by the rotary shaft 15, the vanes 18 also rotate with the rotor 16, oil is sucked from the suction port 42 by a known function of the vane pump, and then discharged to the discharge port 44. The discharge rate is controlled by the lever-like piston 28. Specifically, the lever-like piston 28 rocks about the pin 30 according to the hydraulic pressure of the oil chamber 38, which rocks the cam ring 14 about the pin 24 to control the eccentricity of the cam ring 14. Thus, the discharge rate is controlled.

During the above operation of the vane pump, oil leaked from the discharge side leaks through small clearances between the cam ring 14 and the housings 10 and 12 into the lubricating groove 50. Since the oil flowed into the lubricating groove 50 also flows to the suction side through the groove, the suction side of the cam ring 14 is lubricated. Specifically, oil flowing out to the clearances between the cam ring 14 and the housings 10 and 12 is very small in amount at the suction side, and the suction side tends to be lacking in lubricating oil, but sufficient oil is supplied from the lubricating groove 50, thereby enabling smooth operation of the cam ring 14 without seizing. Furthermore, since the oil flowing into the lubricating groove 50 has passed through the small clearances between the housings 10 and 12 and the cam ring 14, particulates and the like greater than the clearance will not flow into the lubricating groove 50, and small dust flowing through the small clearance flows out through the clearance, dust will not stay within the lubricating groove 50. Therefore, the cam ring 14 is prevented from seizing or the like.

Figure 4:
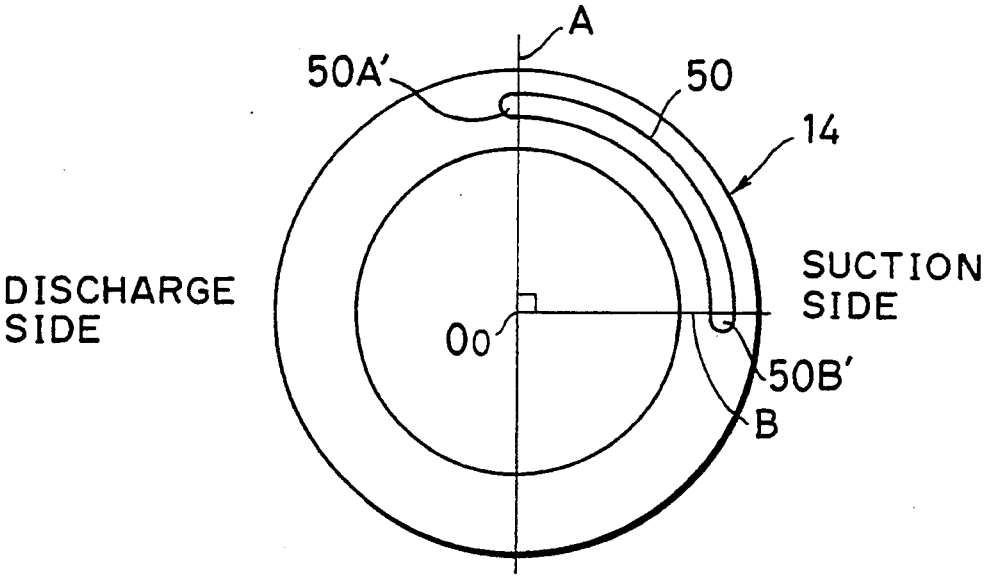
FIG. 4 is a schematic illustration showing a cam ring in another embodiment.
Figure 5:
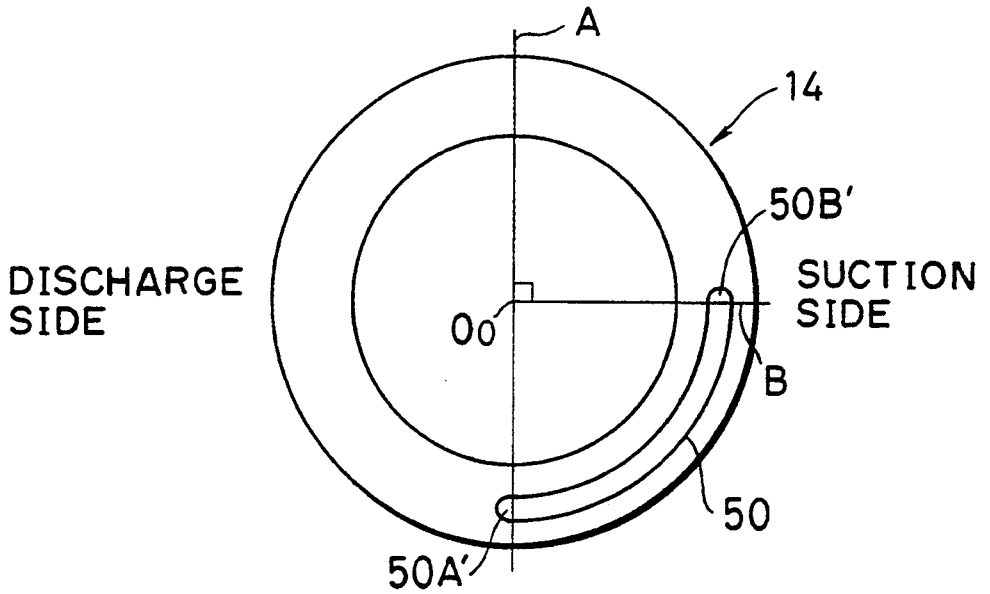
FIG. 5 is a schematic illustration showing a cam ring in another embodiment.
Figure 6:
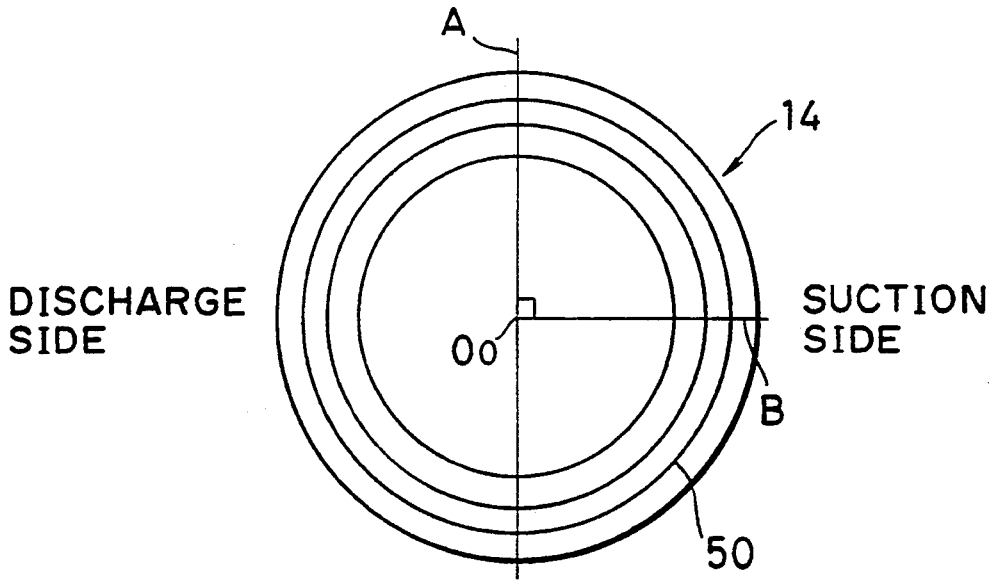
FIG. 6 is a schematic illustration showing a cam ring in another embodiment.

In the above embodiment, the lubricating groove 50 has a circumferential length exceeding a semicircumference, however, alternatively, one which has a circumferential length joining the upper or lower dead point position with the suction port central side position may be used, for example, as shown in FIG. 4, FIG. 5, or FIG. 6.

In the embodiment shown in FIG. 4, one end 50A' of the lubricating groove 50 crosses the upper dead point side of the straight line A, and the other end 50B' crosses the straight line B.

In the embodiment shown in FIG. 5, one end 50A' of the lubricating groove 50 crosses the lower dead point side of the straight line A, and the other end 50B' crosses the straight line B.

In the embodiment shown in FIG. 6, the lubricating groove 50 is provided over the entire circumference on the side surface of the cam ring 14.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. A variable-displacement vane pump comprising housings as a casing of an oil pump, a cam ring having an adjustable eccentricity provided in a chamber formed by said housings, a rotor disposed in a bore of said cam ring, a plurality of vanes supported by said rotor movable in a radial direction and rotatable with said rotor in contact with the inner peripheral surface of said cam ring, a piston capable of adjusting the eccentricity of said cam ring; and wherein a lubricating groove is provided on a side surface of said cam ring, not communicating with inner and outer peripheries of said cam ring nor with other oil passages, said lubricating groove intersects a first straight line on the side surface of said cam ring joining the upper and lower dead points at least at one end of said lubricating groove, and the other end of said lubricating groove intersects a second straight line on the side surface of said cam ring perpendicularly crossing said first straight line and extending from the central point of said cam ring to a suction port side.

2. The variable-displacement vane pump as claimed in claim 1, wherein said lubricating groove intersects said first straight line on the side surface of said cam ring joinning the upper and lower dead points at both ends of said lubricating groove, and said lubricating groove intersects said second straight line on the side surface of said cam ring perpendicularly crossing said first straight line and extending from the central point of said cam ring to the suction port side.

3. The variable-displacement vane pump as claimed in claim 1, wherein said lubricating groove is formed over the entire circumference on the side surface of said cam ring.

* * * * *